US008484902B1

(12) United States Patent
Brown et al.

(10) Patent No.: US 8,484,902 B1
(45) Date of Patent: Jul. 16, 2013

(54) WINDOW ASSEMBLY HAVING A THERMAL BREAK LINER

(71) Applicants: John E. Brown, Panama, NY (US); David R. Ahlstrom, Dewittville, NY (US)

(72) Inventors: John E. Brown, Panama, NY (US); David R. Ahlstrom, Dewittville, NY (US)

(73) Assignee: Hope's Window, Inc., Jamestown, NY (US)

( * ) Notice: Subject to any disclaimer, the term of this patent is extended or adjusted under 35 U.S.C. 154(b) by 0 days.

(21) Appl. No.: 13/653,533

(22) Filed: Oct. 17, 2012

(51) Int. Cl.
*E06B 1/04* (2006.01)

(52) U.S. Cl.
USPC ..... 49/504; 49/401; 52/717.02; 52/204.597; 52/204.6; 52/204.71

(58) Field of Classification Search
USPC ..... 52/204.591, 204.593, 204.597, 212, 52/204.53, 204.54, 204.6, 204.62, 204.71, 52/204.72, 717.02; 49/400–402, 504
See application file for complete search history.

(56) References Cited

U.S. PATENT DOCUMENTS 2,219,688 A * 10/1940 Knudsen ..... 52/208
3,308,582 A * 3/1967 Bakke ..... 49/383
4,187,657 A * 2/1980 Sukolics ..... 52/204.591
4,309,845 A * 1/1982 Schmidt ..... 49/501
4,432,179 A * 2/1984 Bachmann ..... 52/204.593
4,495,726 A * 1/1985 Lindstrom ..... 49/401
4,614,062 A * 9/1986 Sperr ..... 49/504
4,948,206 A * 8/1990 Fitzpatrick ..... 312/296
5,044,121 A * 9/1991 Harbom et al. ..... 49/401
5,214,877 A * 6/1993 Kaspar et al. ..... 49/70
5,373,671 A * 12/1994 Roth et al. ..... 52/204.1
5,617,695 A * 4/1997 Brimmer ..... 52/717.02
5,768,836 A * 6/1998 Bachmann ..... 52/204.51
7,975,432 B2 * 7/2011 Morton et al. ..... 49/246
8,322,090 B2 * 12/2012 Moriya et al. ..... 52/204.591
2010/0031591 A1 * 2/2010 Gallagher ..... 52/204.591

* cited by examiner

*Primary Examiner* — Robert Canfield
*Assistant Examiner* — Brent W Herring
(74) *Attorney, Agent, or Firm* — The Bilicki Law Firm, P.C.; Rebecca Tapscott; Byron Bilicki

(57) ABSTRACT

A window assembly includes a window frame having a front wall and a lateral wall, the window frame being set within a building opening. A thermal break liner having a laterally extending portion is provided wherein the laterally extending portion is positioned on the lateral wall of the window frame. The window assembly also includes a glazing with at least one pane of glass mounted in the window frame, a glazing bead for holding the glazing in place against the window frame, and a glazing bead retainer fixed to the thermal break liner for retaining the glazing bead in place on the thermal break liner. The thermal break liner is formed of a material having a low thermal transmittance factor and is positioned to prevent direct contact and thermal transfer between the glazing bead and the window frame. The window assembly may be a fixed or operable window assembly.

10 Claims, 4 Drawing Sheets

WINDOW ASSEMBLY HAVING A THERMAL BREAK LINER

TECHNICAL FIELD

This application is related, generally and in various embodiments, to a window assembly having a thermal break liner for preventing thermal transfer between an interior and exterior of the window assembly.

DETAILED DESCRIPTION OF THE EMBODIMENTS

Figures 1, 2, 3:
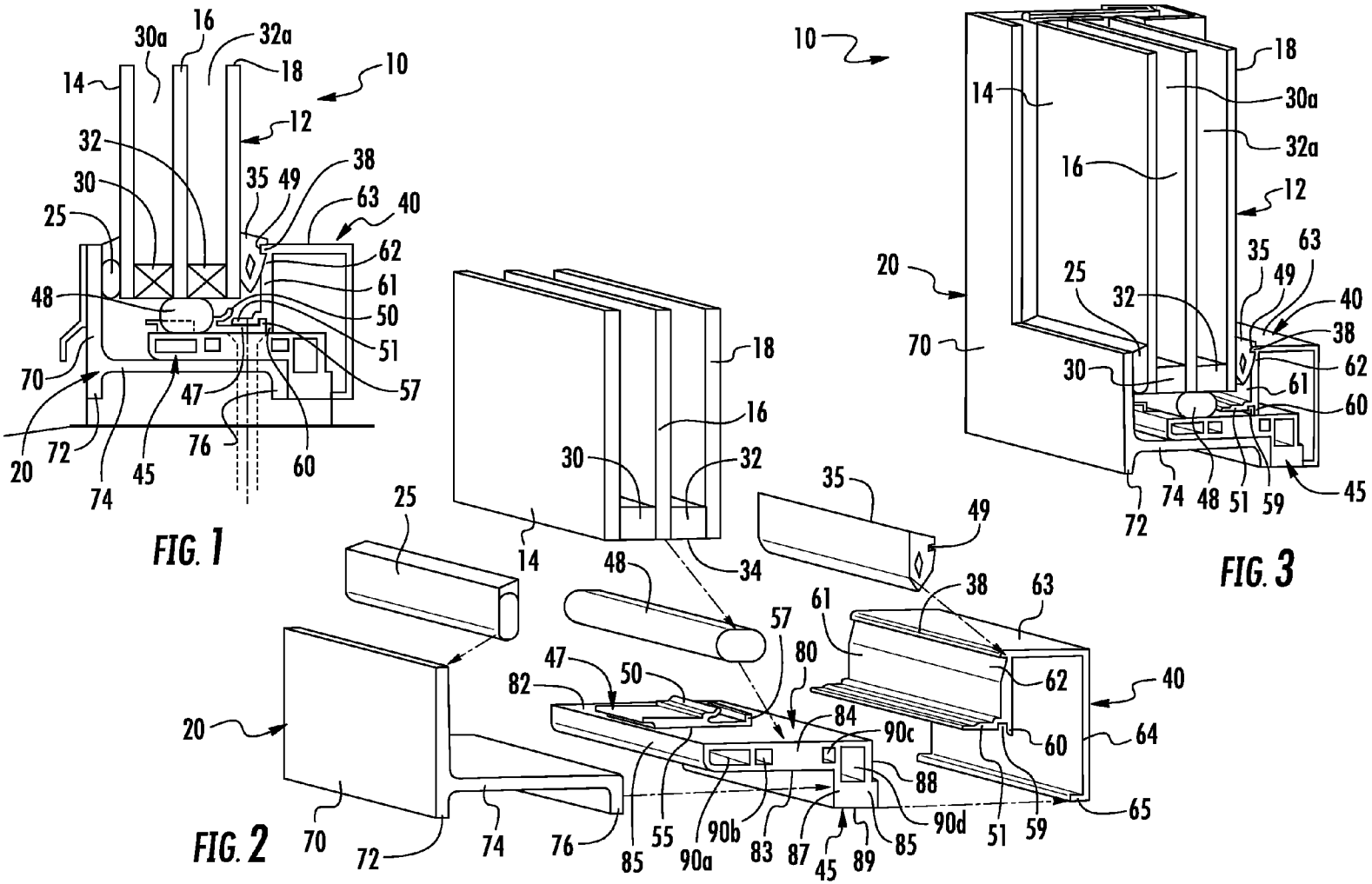
FIG. 1 is a cross-sectional view of a window assembly having a thermal break liner.
FIG. 2 is an exploded view of the window assembly shown in FIG. 1.
FIG. 3 is a perspective view of a section of the window assembly of FIGS. 1 and 2.

With reference to FIGS. 1-3 a first embodiment of a window assembly 10 is illustrated. Window assembly 10 includes a glazing 12 with three parallel sheets or panes of glass 14, 16, and 18 mounted in a window frame 20. A cap seal 25 is mounted between the frame 20 and glazing 12. Cap seal 25 may be formed of a calking material and serves to seal frame 20 to glazing 12. Glazing tape (not shown) may be used to adhere cap seal 25 between frame 20 and glazing 12. Cap seal 25 and glazing tape also serve to minimize vibration between frame 20 and glazing 12.

Additional spacer elements 30 and 32 are mounted between glass panes 14, 16 and 18, to provide gaps 30*a* and 32*a* between the panes of glass. Spacer elements 30 and 32 may be formed of steel. Glazing assembly 12 includes panes 14, 16, and 18 as well as spacer elements 30 and 32. Glazing assembly 12 is sealed and includes a bottom edge 34. In addition, a glazing wedge 35 is positioned between pane 18 of glazing 12 and a glazing bead 40. A thermal break liner 45 is also provided bets en window frame 20 and glazing bead 40. A glazing bead retainer 47 is affixed to thermal break liner 45 and a water sealing element 48 is positioned between bottom edge 34 of glazing 12 and glazing bead retainer 47.

Glazing bead 40 includes a small protruding member 38 which serves to engage a notch 49 formed in glazing wedge 35 and secure it in place against glazing 12. Glazing bead 40 is snap-fitted to glazing bead clip or retainer 47. Alternatively, glazing bead 40 may be fastened to retainer 47 using other mechanical connections such as a hook-on fastener. As illustrated, glazing bead retainer 47 includes a retaining flange 50 for engaging a horizontal projection 51 of glazing bead 40. Glazing bead retainer 47 also includes a thermal break liner contacting portion 55 which rests on thermal break liner 45 as shown in FIG. 2. Thermal break liner contacting portion 55 is a generally horizontal surface which is secured to thermal break liner 45 by a securing means such as mechanical fasteners (not shown). Glazing bead retainer 47 also includes a generally vertical projection 57 which engages a notch 59 in horizontal projection 51 of glazing bead 40 to aid in securing glazing bead 40 to glazing bead retainer 47 and thermal break liner 45. Glazing bead 40 further includes a downward projection 60 positioned adjacent to notch 59 for contacting thermal break liner 45. Additionally, glazing bead 40 includes a generally vertical wall 61 that has a slanted surface 62 which rests against glazing wedge 35 to indirectly retain glass sheets 14, 16 and 18 in place. A top edge 63 extends perpendicular to vertical window retaining flange 61 and includes protruding member 38 for engaging notch 49 in glazing wedge 35. Glazing bead 40 also includes a wall 64 extending perpendicular to top edge 63 and an inward projection 65 extending perpendicularly from wall 64 for abutting thermal break liner 45. As illustrated in FIGS. 1 and 3, glazing bead 40 has a hollow profile.

Glazing bead retainer 47 may be formed of a continuous piece that runs the length of thermal break liner 45 and window frame 20 or may be composed of short lengths spaced intermittently along thermal break liner as shown in FIG. 2. In addition, glazing bead retainer 47 may fabricated from either ferrous or non-ferrous metal, or plastics. Glazing bead 40 may be formed of aluminum, bronze or steel, although other metallic or plastic materials may be used. For example, glazing bead 40 may be formed from a material such as fiberglass, vinyl, plastics, ceramics or a combination thereof. In one embodiment, a fiberglass pultrusion process may be used to glazing bead 40 in which fiberglass ropes are covered with resin and pulled through a die.

Frame 20, also known as a sill bar, generally includes a front wall 70 having an extended rim portion 72, a lateral wall 74 and a second rim portion 76, spaced apart from and parallel to extended rim portion 72. Frame 20 may be set into a building opening in an equal leg/flush or an extended flange setting condition. In addition, frame 20 is formed from a material such as aluminum, steel, bronze, brass, or combinations thereof. Thermal break liner 45 is positioned such that it thermally isolates and prevents thermal transfer from window frame 20 to glazing bead 40. Window frame 20 is configured to be exposed only to the environment exterior to window assembly 10 and glazing bead is configured such that it is only exposed to the environment interior to window assembly 10. Thermal break liner 45 is positioned between window frame 20 and glazing bead 40 such that there is no contact or thermal exposure between window frame 20 and glazing bead 40. As shown in FIGS. 1-3, thermal break liner 45 includes a laterally extending portion 80 having a top surface 82 and a bottom surface 83 with a thickness 84 therebetween. Laterally extending portion 80 terminates at an edge 85 on one end and at a foot portion 86 at a second end. Foot portion 86 includes a first surface 87, a second surface 88, and a bottom surface 89.

Cavities may be formed in thermal break liner 45, such as cavities 90*a*, 90*b*, and 90*c* in laterally extending portion 80 or cavity 90*d* in foot portion 86. In another embodiment, thermal break liner 45 may be formed from a solid material. Thermal break liner 45 is formed from a material such as fiberglass, vinyl, plastics, ceramics or a combination. A fiberglass pultrusion process may be used to form thermal break liner 45 in which fiberglass ropes are covered with resin and pulled through a die.

Laterally extending portion 80 of thermal break liner 45 is affixed to lateral wall 74 of window frame 20. In particular, bottom surface 83 of laterally extending portion 80 abuts lateral wall 74 and first surface 87 of foot portion 86 abuts second rim portion 76 of window frame 20. In addition, second surface 88 of foot portion 86 abuts inward projection of 65 of glazing bead 40 and provides separation and thermal isolation of window frame 20 and glazing bead 40. An adhesive is positioned between window frame 20 and thermal break liner 45 to prevent separation and such that thermal break liner 45 lines window frame 20.

As discussed above, glazing bead retainer 47 is attached to thermal break liner 45 by a securing means such as mechanical fasteners (not shown). Glazing bead 410 then snaps into glazing bead retainer 47, which includes a retaining flange 50 for engaging a horizontal projection 51 of glazing bead 40. Since both glazing bead 40 and window frame 20 are typically formed of a metallic material with a high thermal transmittance factor, such as aluminum, bronze or steel, thermal break liner 45 acts as a barrier and slows the heat transfer between glazing bead and window frame 20. The material of thermal break liner 45 has a low thermal transmittance factor. Thermal break liner 45 is positioned such that there is no direct contact between glazing bead 40 and window frame 20. In addition, thermal break liner 45, along with seals 25, 35 and 48, acts to prevent heat transfer between glazing assembly 12 and glazing bead 40 and/or window frame 20.

Figure 4:
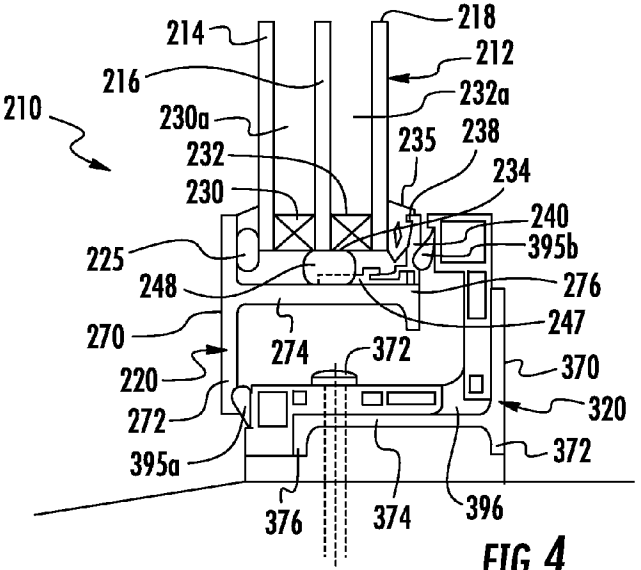
FIG. 4 is a cross-sectional view of another embodiment of a window assembly having thermal break liners.
Figure 5:
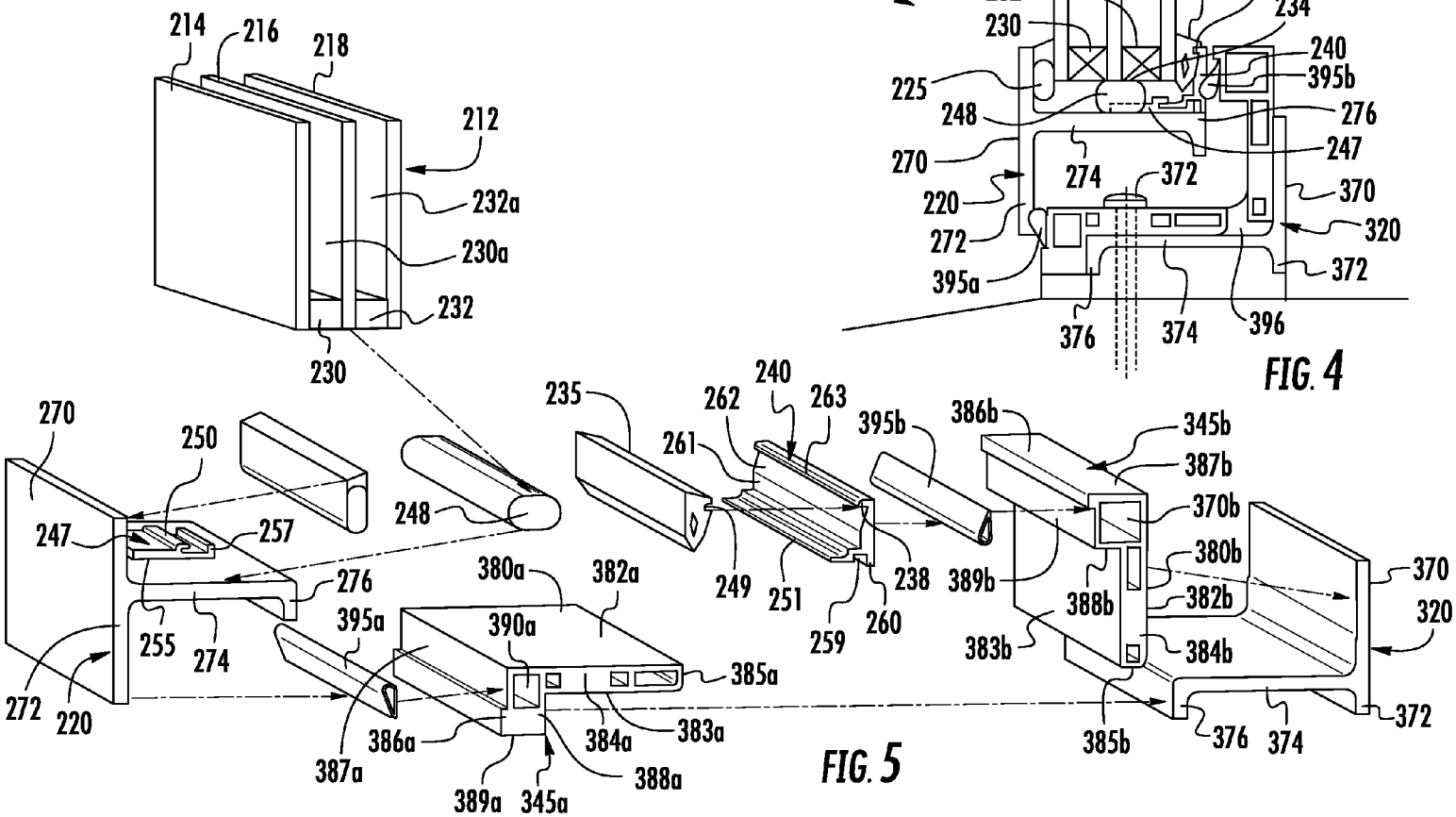
FIG. 5 is an exploded view of the window assembly of FIG. 4.
Figure 7:
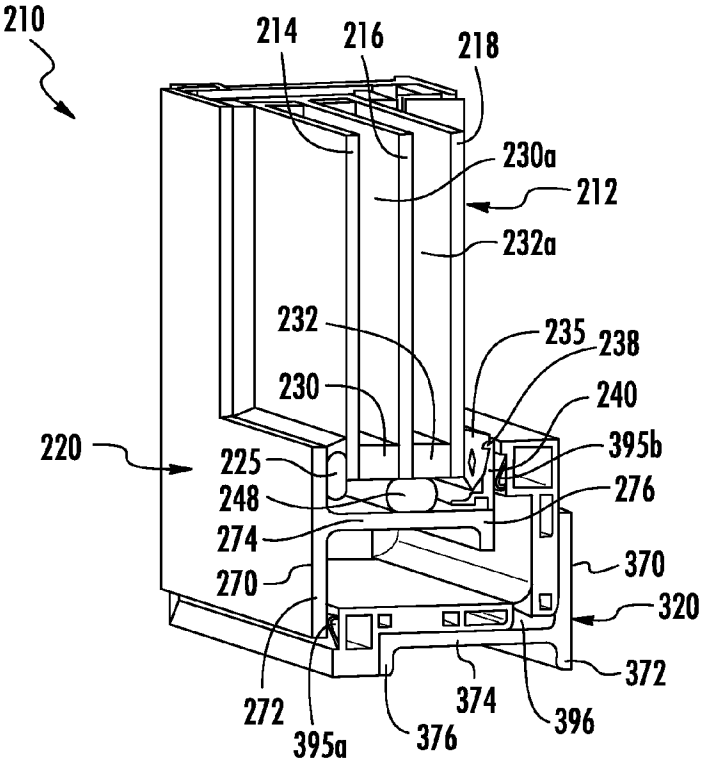
FIG. 7 is perspective view of a section of the window assembly of FIGS. 4-5 in a closed position.
Figure 6:
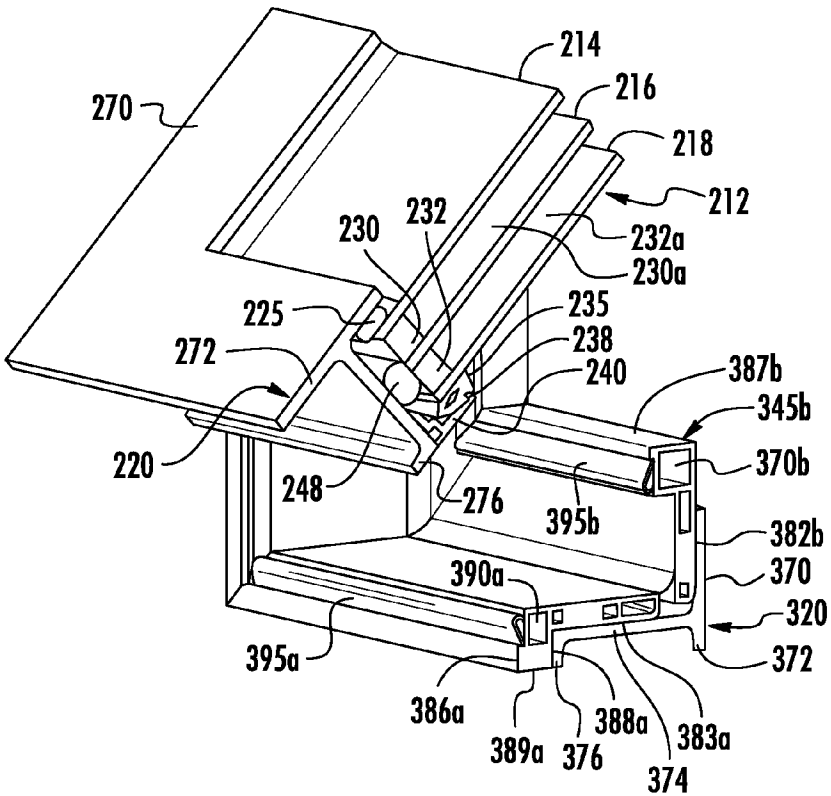
FIG. 6 is perspective view of a section of the window assembly of FIGS. 4-5 in an open position.

A second embodiment of a window assembly 210 is shown in FIGS. 4-7. Window assembly 210 is an operative window capable of moving between an open position and a closed position, as shown in FIGS. 6 and 7, respectively. Window assembly 210 includes a glazing 212 with three parallel sheets or panes of glass 214, 216, and 218 mounted to an outer window frame 220. A cap seal 225 is mounted between outer window frame 220 and glazing 212. Cap seal 225 may be formed of a calking material and serves to seal outer window frame 220 to glazing 212. Glazing tape (not shown) may be used to adhere cap seal 225 between outer window frame 220 and glazing 212. Cap seal 225 and glazing tape also serve to minimize vibration between outer window frame 220 and glazing 212.

Additional spacer elements 230 and 232 are mounted between glass panes 214, 216 and 218, to provide gaps 230*a* and 232*a* between the panes of glass. Spacer elements 230 and 232 may be formed of steel. Glazing assembly 212 includes panes 214, 216, and 218 as well as spacer elements 230 and 232. Glazing assembly 212 is sealed and includes a bottom edge 234. In addition, a glazing wedge 235 is positioned between pane 218 of glazing 212 and a glazing bead 240. A glazing bead retainer 247 is affixed to outer window frame 220 and a water sealing element 248 is positioned between bottom edge 234 of glazing 212 and glazing bead retainer 247.

Glazing bead 240 includes a small protruding member 238 which serves to engage a notch 249 formed in glazing wedge 235 and secure it in place against glazing 212. Glazing bead 240 is snap-fitted to glazing bead clip or retainer 247. As illustrated, glazing bead retainer 247 includes a retaining flange 250 for engaging a horizontal projection 251 of glazing bead 240. Glazing bead retainer 247 also includes an outer window frame contacting portion 255 which rests on outer window frame 220 as shown in FIG. 5. Outer window frame contacting portion 255 is a generally horizontal surface which is secured to outer window frame 220 by a securing means such as mechanical fasteners (not shown). Glazing bead retainer 247 also includes a generally vertical projection 257 which engages a notch 259 in horizontal projection 251 of glazing bead 240 to aid in securing glazing bead 240 to glazing bead retainer 247 and outer window frame 220. Glazing bead 240 further includes a downward projection 260 positioned adjacent to notch 259 for contacting outer window frame 220. Additionally, glazing bead 240 includes a generally vertical wall 261 that has a slanted surface 262 which rests against glazing wedge 235 to indirectly retain glass sheets 214, 216 and 218 in place. A top edge 263 extends perpendicular to vertical window retaining flange 261 and includes protruding member 238 for engaging notch 249 in glazing wedge 235.

Glazing bead retainer 247 may be formed of a continuous piece that runs the length of outer window frame 220 or may be composed of short lengths spaced intermittently along outer window frame 220 as shown in FIG. 5. In addition, glazing bead retainer 247 may fabricated from either ferrous or non-ferrous metal, or plastics. Glazing bead 240 may be formed of aluminum, bronze or steel, although other metallic or plastic materials may be used.

Outer frame 220, also known as a sill bar, generally includes a front wall 270 having an extended rim portion 272, a lateral wall 274 and a second rim portion 276, spaced apart from and parallel to extended rim portion 272. Outer window frame 20 is formed from a material such as aluminum, steel, bronze, brass, or combinations thereof.

Window assembly 210 also includes an inner window frame 320 including an upstanding wall 370 having an extended rim portion 372, a lateral wall 374 and a second rim portion 376, spaced apart from and parallel to extended rim portion 372. Inner window frame 320 is formed from a material such as aluminum, steel, bronze, brass, or combinations thereof.

First and second thermal break liners 345*a* and 345*b* are positioned on inner window frame 320 such that they thermally isolate and prevent thermal transfer from outer window frame 220 to inner window frame 320, thereby preventing thermal transfer from outside window assembly 210 to inside window assembly 210. As shown in FIGS. 4 and 5, each of thermal break liners 345*a* and 345*b* includes a laterally extending portion 380*a*, 380*b* having a first side 382*a*, 382*b* and a second side 383*a*, 383*b* with a thickness 384*a*, 384*b* therebetween. Laterally extending portions 380*a*, 380*b* terminate at an edge 385*a*, 385*b* on one end and at a foot portion 386*a*, 386*b* at a second end. Foot portions 386*a*, 386*b* each include a first surface 387*a*, 387*b*, a second surface 388*a*, 388*b*, and an end surface 389*a*, 389*b*.

Cavities may be formed in thermal break liners 345*a* and 345*b*, such as cavities 390*a* and 390*b*. Additional cavities (not separately labeled) may also be formed in thermal break liners 345*a* and 345*b*. In another embodiment, thermal break liners 345*a* and 345*b* may be formed from a solid material. Thermal break liners 345*a* and 345*b* are formed from a material such as fiberglass, vinyl, plastics, ceramics or a combination. A fiberglass pultrusion process may be used to form thermal break liners 345*a* and 345*b* in which fiberglass ropes are covered with resin and pulled through a die.

Laterally extending portion 380*a* of thermal break liner 345*a* is affixed to lateral wall 374 of inner window frame 320. In particular, second side 383*a* of laterally extending portion 380*a* abuts lateral wall 374 and second surface 388*a* of foot portion 386*a* abuts second rim portion 376 of inner window frame 320. An adhesive is positioned between inner window frame 320 and thermal break liner 345*a* to prevent separation and such that thermal break liner 345*a* lines window frame 320. A fastener, such as screw 392 shown in FIG. 4, may be used to attach thermal break liner 345*a* to inner window frame 320. In addition, a sealing element or weather strip 395*a* is positioned between first surface 387*a* of foot portion 386*a* and outer window frame 220, as shown in FIG. 4 when window assembly 210 is in a closed position.

In addition, thermal break liner 345*b* further lines inner window frame 320 in window assembly 210. Laterally extending portion 380*b* of thermal break liner 345 is affixed to upstanding wall 370 of inner window frame 320. In particular, first side 382*b* of laterally extending portion 380*b* abuts upstanding wall 370 of inner window frame 320. An adhesive is positioned between inner window frame 320 and thermal break liner 345*b* to prevent separation and such that thermal break liner 345*b* lines window frame 320. In addition, a sealing element or weather strip 395*b* is positioned between end surface 389*b* of foot portion 386*b* and glazing bead 240, as shown in FIG. 4 when window assembly 210 is in a closed position. A gap joint (rot separately labeled) exists between end 385*b* of thermal break liner 345*b* and end 385*a* of thermal break liner 385*a*, as shown in FIG. 4. A sealant 396 may be used to fill the gap joint and further secure thermal break liners 345*a* and 345*b* to inner window frame 320.

As discussed above, glazing bead retainer 247 is attached to outer window frame 220. Glazing bead 240 then snaps into glazing bead retainer 247, which includes a retaining flange 250 for engaging a horizontal projection 251 of glazing bead 240. Since both glazing bead 240 and window frame 220, as well as inner window frame 320, are typically formed of a metallic material with a high thermal transmittance factor, such as aluminum, bronze or steel, thermal break liners 345*a* and 345*b* act as barriers and slow the heat transfer between glazing bead 240, outer window frame 220, and inner window frame 320. Glazing bead 240, window frame 220, and/or inner window frame 320 may each be constructed of a solid piece in order to strengthen window assembly 210. The material of thermal break liners 345*a* and 345*b* has a low thermal transmittance factor. Thermal break liners 345*a* and 345*b* are positioned such that there is no direct contact between glazing bead 240, outer window frame 220, and inner window frame 320. In addition, thermal break liners 345*a* and 345*b*, along with seals 225, 235 and 248, act to prevent heat transfer between glazing assembly 212 and glazing bead 240 and/or outer window frame 220, and inner window frame 320.

As illustrated in FIGS. 6 and 7, window assembly 210 is capable of moving between an open position (FIG. 6) and a closed position (FIG. 7). When in an open position, outer window frame 220 with glazing retainer 247, cap seal 225, glazing 212, glazing wedge 235 and glazing bead 240 move as a unit and pivot or move away from inner window frame 320, and thermal break liners 345*a* and 345*b*, thereby leaving window assembly 210 in an open position. When window assembly 210 is in a closed position, weather strips 395*a* and 395*b* act to further seal window assembly 210 and prevent wind from entering a building through window assembly 210.

Figure 9:
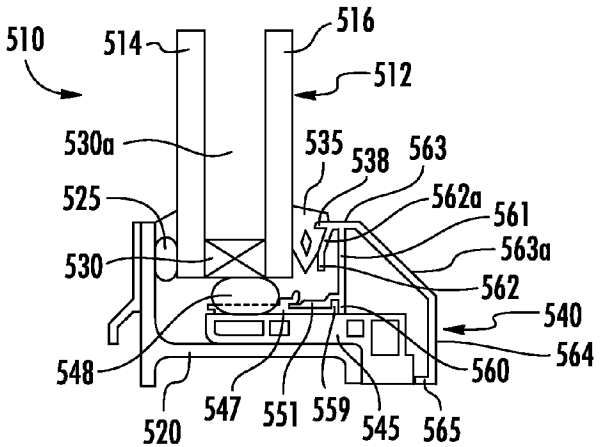
FIG. 9 is a cross-sectional view of another alternate embodiment of a fixed frame window assembly.
Figure 8:
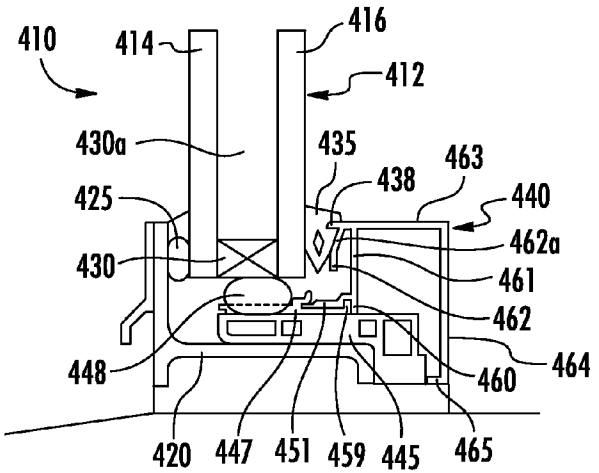
FIG. 8 is a cross-sectional view of an alternate embodiment of a fixed frame window assembly.

FIGS. 8-9 illustrate additional embodiments of a fixed frame window assembly. FIG. 8 illustrates a window assembly 410 having a glazing 412 with two panes 414 and 416 with a spacer element 430 therebetween. Spacer element 430 provides a gap 430*a* between panes 414 and 416. Window assembly 410 also includes a window frame 420, thermal break liner 445, glazing wedge 435, and water seal 448. Each of these elements corresponds to similar elements described with respect to window assembly 10 and will not be discussed separately. Glazing bead 440 of window assembly 410 is an alternate to glazing bead 40 described with respect to window assembly 10. Glazing bead 440 includes a horizontal projection 451 to aid in securing glazing bead 440 to glazing bead retainer 447 and thermal break liner 445. Glazing bead 440 includes a notch 459 for engaging a generally vertical projection (not labeled) in glazing bead retainer 447. Glazing bead 440 further includes a downward projection 460 positioned adjacent to notch 459 for contacting thermal break liner 445. Additionally, glazing bead 440 includes a generally vertical wall 461 with a flange projection 462 which rests against glazing wedge 435 to indirectly retain glass sheets 414 and 416 in place. A gap 462*a* is present between generally vertical wall 461 and flange projection 462. A top edge 463 extends perpendicular to generally vertical wall 461. A protruding member 438 for engaging a notch (not labeled) in glazing wedge 435 is also present. Glazing bead 440 also includes a wall 464 extending perpendicular to top edge 463 and an inward projection 465 extending perpendicularly from wall 464 for abutting thermal break liner 445. As illustrated in FIG. 8, glazing bead 440 has a hollow profile. Thermal break liner 445 is positioned such that there is no direct contact between glazing bead 440 and window frame 420. In addition, thermal break liner 445, along with seals 425, 435 and 448, acts to prevent heat transfer between glazing assembly 412 and glazing bead 440 and/or window frame 420.

FIG. 9 illustrates an alternate fixed window assembly 510 having a glazing 512 with two panes 514 and 516 with a spacer element 530 therebetween. Spacer element 530 provides a gap 530*a* between panes 514 and 516. Window assembly 510 also includes a window frame 520, thermal break liner 545, glazing wedge 535, and water seal 548. Each of these elements corresponds to similar elements described with respect to window assembly 10 and will not be discussed separately. Glazing bead 540 of window assembly 510 is an alternate to glazing bead described with respect to window assembly 10. Glazing bead 540 includes a horizontal projection 551 to aid in securing glazing bead 540 to glazing bead retainer 547 and thermal break liner 545. Glazing bead 540 includes a notch 559 for engaging a generally vertical projection (not labeled) in glazing bead retainer 547. Glazing bead 540 further includes a downward projection 560 positioned adjacent to notch 559 for contacting thermal break liner 545. Additionally, glazing bead 540 includes a generally vertical wall 561 with a flange projection 562 which rests against glazing wedge 535 to indirectly retain glass sheets 514 and 516 in place. A gap 562*a* is present between generally vertical wall 561 and flange projection 562. A top edge 563 extends perpendicular to generally vertical wall 561. A protruding member 538 for engaging a notch (not labeled) in glazing wedge 535 is also present. Glazing bead 540 also includes an angled edge 563*a* and wall 564 extending perpendicular to top edge 563 and an inward projection 565 extending perpendicularly from wall 564 for abutting thermal break liner 545. As illustrated in FIG. 9, glazing bead 540 has a hollow profile. Thermal break liner 545 is positioned such that there is no direct contact between glazing bead 540 and window frame 520. In addition, thermal break liner 545, along with seals 525, 535 and 548, acts to prevent heat transfer between glazing assembly 512 and glazing bead 540 and/or window frame 520.

Figure 11:
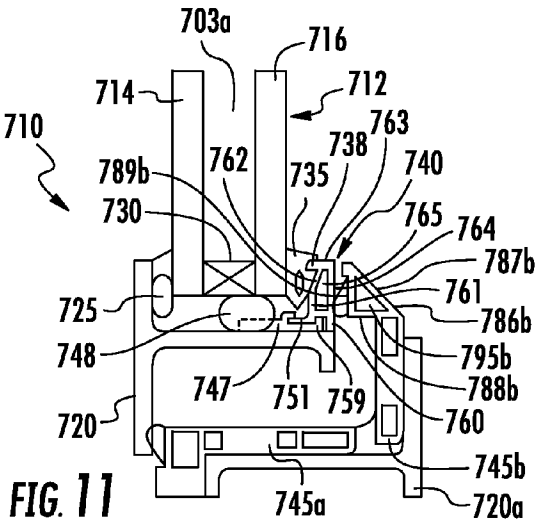
FIG. 11 is a cross-sectional view of another alternate embodiment of an operable frame window assembly.
Figure 10:
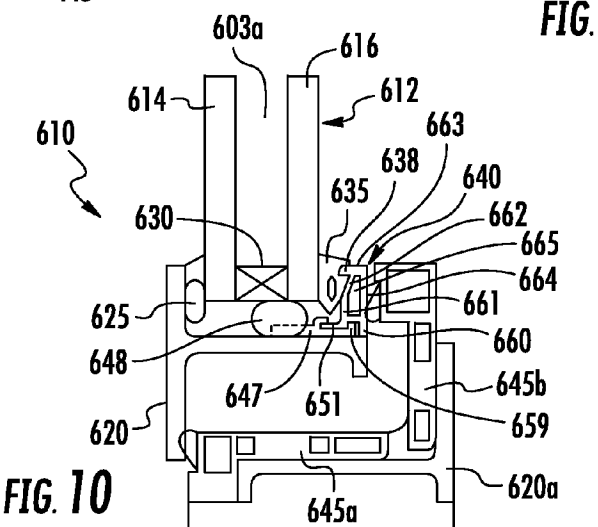
FIG. 10 is a cross-sectional view of an alternate embodiment of an operable frame window assembly.

FIGS. 10-11 illustrate additional embodiments of an operable frame window assembly. FIG. 10 illustrates a window assembly 610 having a glazing 612 with two panes 614 and 616 with a spacer element 630 therebetween. Spacer element 630 provides a gap 630*a* between panes 614 and 616. Window assembly 610 also includes an outer window frame 620, inner window frame 620*a*, thermal break liners 645*a* and 645*b*, cap seal 625, glazing wedge 635, and water seal 648. Each of these elements corresponds to similar elements described with respect to window assembly 210 and will not be discussed separately. Glazing bead 640 of window assembly 610 is an alternate to glazing bead 240 described with respect to window assembly 210. Glazing bead 640 includes a horizontal projection 651 to aid in securing glazing bead 440 to glazing bead retainer 647 and outer window frame 620. Glazing bead 640 includes a notch 659 for engaging a generally vertical projection (not labeled) in glazing bead retainer 647. Glazing bead 640 further includes a downward projection 660 positioned adjacent to notch 659 for contacting outer window frame 620. Additionally, glazing bead 640 includes a generally vertical wall 661 with a slanted portion 662 which rests against glazing wedge 635 to indirectly retain glass sheets 614 and 616 in place. A top edge 663 extends perpendicular to generally vertical wall 661. A protruding member 638 for engaging a notch (not labeled) in glazing wedge 635 is also present. Glazing bead 640 also includes a wall 664 extending perpendicular to top edge 663. As illustrated in FIG. 10, glazing bead 640 has a hollow profile with an interior space 665 formed therein. Thermal break liners 645*a* and 645*b* are positioned such that there is no direct contact between glazing bead 640, outer window frame 620 and inner window frame 620*a*. In addition, thermal break liners 645*a* and 645*b*, along with seals 625, 635 and 648, act to prevent heat transfer between glazing assembly 612 and glazing bead 640 and/or outer window frame 620 and inner window frame 620*a*.

FIG. 11 illustrates a window assembly 710 having a glazing 712 with two panes 714 and 716 with a spacer element 730 therebetween. Spacer element 730 provides a gap 730*a* between panes 714 and 716. Window assembly 710 also includes an outer window frame 720, inner window frame 720*a*, thermal break liners 745*a*, cap seal 725, glazing wedge 735, and water seal 748. Each of these elements corresponds to similar elements described with respect to window assembly 210 and will not be discussed separately. Glazing bead 740 of window assembly 710 is an alternate to glazing bead 240 described with respect to window assembly 210. In addition, thermal break liner 745*b* is an alternate to thermal break liner 345*b* of window assembly 210. Glazing bead 740 includes a horizontal projection 751 to aid in securing glazing bead 740 to glazing bead retainer 747 and outer window frame 720. Glazing bead 740 includes a notch 759 for engaging a generally vertical projection (not labeled) in glazing bead retainer 747. Glazing bead 740 further includes a downward projection 760 positioned adjacent to notch 759 for contacting outer window frame 720. Additionally, glazing bead 740 includes a generally vertical wall 761 with a slanted portion 762 which rests against glazing wedge 735 to indirectly retain glass sheets 714 and 716 in place. A top edge 763 extends perpendicular to generally vertical wall 761. A protruding member 738 for engaging a notch (not labeled) in glazing wedge 735 is also present. Glazing bead 740 also includes a wall 764 extending perpendicular to top edge 763. As illustrated in FIG. 11, glazing bead 740 has a hollow profile with an interior space 765 formed therein.

Thermal break liner 745*b* includes a foot portion 786*b* having a first surface 787*b*, a second surface 788*b*, and an end surface 789*b*. First surface 789*b*. First surface 787*b* is in the form of an angled edge which provides window assembly 710 with an angled inner perimeter. A triangular cavity 795*b* is provided within foot portion 786*b*. Thermal break liners 745*a* and 745*b* are positioned such that there is no direct contact between glazing bead 740, outer window frame 720 and inner window frame 720*a*. In addition, thermal break liners 745*a* and 745*b*, along with seals 725, 735 and 748, act to prevent heat transfer between glazing assembly 712 and glazing bead 740 and/or outer window frame 720 and inner window frame 720*a*.

In general, the thermal break liners disclosed in the various embodiments of window assemblies isolate exterior temperatures, which may be extremely cold, from interior temperatures, which typically remain at about 70 degrees F. Thus, the thermal break liners prevent the transfer of cold thru the window frame from the exterior to the warmer interior, which could lead to condensation issues. As discussed above, the thermal break liners are formed of a material having a low thermal conductivity such that they isolate any material that is exposed directly to the exterior from the warmer interior air. Conversely, the thermal break liners isolate any material that is directly exposed to the interior from the colder exterior air. Thus, any transfer of cold from the exterior to the interior that is going thru the window assembly must pass thru a low thermal conductive material of the thermal break liners first. The conductive material slows the transfer rate down such that the interior material is barely affected by any cold and therefore, there is a very low chance of condensation on the inside of the window assembly.

The foregoing descriptions of specific embodiments of the present invention have been presented for purposes of illustration and description. They are not intended to be exhaustive or to limit the invention to the precise forms disclosed, and various modifications and variations are possible in light of the above teachings. The embodiments were chosen and described in order to explain the principles of the invention and its practical application, to thereby enable others skilled in the art to utilize the invention and various embodiments with various modifications as are suited to the particular use contemplated.

We claim:

1. A window assembly capable of opening and closing, said window assembly comprising:

an inner window frame having a front wall having an extended rim portion, a lateral wall and a second rim portion, spaced apart from and parallel to the extended rim portion, the inner window frame being set within a building opening;

an outer window frame having a front wall having an extended rim portion, a lateral wall and a second rim portion, spaced apart from and parallel to the extended rim portion;

a glazing including at least one pane of glass mounted in the outer window frame;

a glazing bead positioned against the glazing for holding the glazing in place against the outer window frame;

a glazing bead retainer fixed to the lateral wall of the outer window frame for retaining the glazing bead in place on the outer window frame;

a first thermal break liner having a laterally extending portion with an edge on one end, a foot portion at a second end, a top surface and a bottom surface with a thickness therebetween, said bottom surface positioned on said lateral wall of the inner window frame, and said foot portion positioned adjacent to the extended rim portion of the outer window frame when the window assembly is in a closed position; and a second thermal break liner having a laterally extending portion with an edge on one end, a foot portion at a second end, a top surface and a bottom surface with a thickness therebetween, said bottom surface positioned on said front wall of the inner window frame, said first and second thermal break liners are formed of a material having a low thermal transmittance factor and are positioned to prevent direct contact and thermal transfer between the glazing bead, the outer window frame, and the inner window frame.

2. The window assembly of claim 1 wherein the first and second thermal break liners include cavities formed therein.

3. The window assembly of claim 1 wherein the first and second thermal break liners are formed from a material from the group consisting of fiberglass, vinyl, plastics, ceramics or a combination thereof.

4. The window assembly of claim 3 wherein the first and second thermal break liners are fiberglass pultrusions.

5. The window assembly of claim 1 wherein the glazing bead is attached to the glazing bead retainer by a snap-fit connection.

6. The window assembly of claim 1 further including a water sealing element positioned between a bottom edge of the glazing and the glazing bead retainer.

7. The window assembly of claim 1 wherein the inner and outer window frames and glazing bead are formed from a material having a high thermal transmittance.

8. The window assembly of claim 7 wherein the inner and outer window frames and glazing bead are formed from a material selected from the group consisting of brass, bronze, steel, aluminum and combinations thereof.

9. The window assembly of claim 1 further including a glazing wedge positioned between the glazing and the glazing bead, wherein the glazing bead includes a wall with a slanted portion for contacting glazing wedge and a protruding member for engaging a notch in the glazing wedge, said glazing bead having a hollow profile.

10. The window assembly of claim 1 wherein the foot portion of the second thermal break liner includes an angled edge which provides the window assembly with an angled inner perimeter.

* * * * *